US008591207B2

(12) United States Patent
Ciavarella

(10) Patent No.: US 8,591,207 B2
(45) Date of Patent: Nov. 26, 2013

(54) PUMP WITH SIDE INLET VALVE FOR IMPROVED FUNCTIONING IN AN INVERTED CONTAINER

(75) Inventor: Nick Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 252 days.

(21) Appl. No.: 12/958,468

(22) Filed: Dec. 2, 2010

(65) Prior Publication Data

US 2012/0141309 A1 Jun. 7, 2012

(51) Int. Cl.
*F04B 35/04* (2006.01)

(52) U.S. Cl.
USPC ..... 417/490; 222/325

(58) Field of Classification Search
USPC ..... 417/490; 222/325
See application file for complete search history.

(56) References Cited

U.S. PATENT DOCUMENTS 3,379,136 A 4/1968 Corsette
3,987,938 A * 10/1976 Cooprider et al. ..... 222/209
4,890,773 A 1/1990 Corsette
6,536,629 B2 3/2003 van de Heijden
7,011,237 B1 3/2006 Sayers
7,461,762 B2 12/2008 Law
7,938,297 B2 5/2011 Law

* cited by examiner

*Primary Examiner* — Charles Freay
*Assistant Examiner* — Patrick Hamo
(74) *Attorney, Agent, or Firm* — Calfee, Halter & Griswold LLP

(57) ABSTRACT

A pump for use in an inverted dispenser is disclosed herein. In one embodiment, the liquid pump includes a fluid chamber that has a top portion when in the inverted position and at least one side wall located below the top portion. A liquid intake port extends through the at least one side wall and allows fluid to flow into the fluid chamber. The pump also includes a check valve to prevent fluid from flowing out of the fluid chamber through the fluid intake port that is located in the at least one side wall. Actuation of the liquid pump in a first direction causes fluid to enter the fluid chamber through the fluid intake port and actuation of the liquid pump in a second direction causes liquid to exit the fluid chamber trough the fluid chamber outlet and out of a dispensing outlet. In one embodiment, the check valve is an elastomeric valve. The elastomeric valve may include a top portion to seal of an inlet opening in the top of an existing pump to convert the pump into a pump having an inlet opening below the top of the pump. In another embodiment, the fluid piston in the liquid pump is the check valve that seals off the intake opening from the fluid chamber when the fluid piston is moved past the inlet opening.

19 Claims, 9 Drawing Sheets

PUMP WITH SIDE INLET VALVE FOR IMPROVED FUNCTIONING IN AN INVERTED CONTAINER

FIELD OF THE INVENTION

The present invention relates to pumps and, particularly, to a pump having a side inlet in a pump chamber. The side inlet facilitates the exhaustion of the contents of a container to which the pump is secured, particularly when the container is used in an inverted position, with the pump being secured to the container through an opening proximate the bottom of the container in the inverted position. The pumps may be simple liquid pumps or foam pumps in which a foamable liquid is mixed with air to dispense a foam product.

BACKGROUND OF THE INVENTION

It is common in the dispensing arts to provide disposable units in which a pump is secured to a container that holds the product that is to be dispensed. Actuating the pump causes the product to be dispensed from the container, and, when the container is empty of product (or the product level is below the pump intake), the unit can be disposed of to be replaced with a new unit. While a multitude of products are dispensed in this manner, various products of particular interest in the present application include soaps and sanitizers, though this invention is not to be limited to or by any particular product to be dispensed.

In some dispensing systems, the combination pump and container are received in a dispenser housing, which provides the actuating mechanisms necessary to actuate the pump and cause the dispensing of product to the individual operating the dispensing system. A particular example is shown in FIGS. 1 and 2, which shows a wall-mounted dispenser 10. The dispenser 10 includes a dispenser housing 12 that is mounted to a wall and opens to receive a combination reciprocating piston pump 14 and container 16, the combination being herein referred to as a "refill unit," which is designated by the numeral 18. In the embodiment shown, a pushbar 20 of the dispenser housing 12 interacts with the reciprocating piston pump 14 of the refill unit 18 such that pushing on the pushbar 20 (typically when the cover 21 of the dispenser housing 20 is closed) causes the reciprocating piston pump 14 to be actuated to dispense product at the outlet of the dispenser 10. This outlet might be provided at the end of a dispensing pathway provided by the pump 14, or might be a separate portion of the dispenser 10, with the dispensing pathway of the reciprocating piston pump 14 appropriately communicating therewith when the refill unit 18 is received in the housing 12. The dispenser housing and refill unit concept is all generally known and currently widely practiced in the dispensing arts, particularly for soaps, sanitizers and lotions and other personal care products.

A cross-section of a refill unit 18 is shown in FIG. 2. The reciprocating piston pump 14 fluidly communicates with a liquid S within the container 16, communicating through an inlet 22 of an axial extension 24 that extends adjacent a valve seat for an inlet valve 28. The inlet valve 28 helps to define a liquid chamber 26, the chamber being defined by the volume within a liquid pump sidewall 50 between the inlet valve 28 and an outlet valve 30. These valves 28, 30 ensure that the reciprocating piston pump 14 operates, upon proper actuation, to advance a dose of liquid S to the dispensing pathway 36 of the pump, ultimately advancing a dose of liquid to the end user, and after actuation and upon return to the rest state due to the spring 34, draws a dose of liquid from the container 16 into the liquid chamber 26.

A liquid piston 32 resides in the liquid chamber 26 and is biased by a spring 34 to a rest position, as shown in FIG. 2, wherein the liquid chamber 26 has an expanded volume, defined between the valves 28, 30 and the sidewall 50. Notably, the piston 32 is termed a "liquid" piston simply because it serves to pump liquid. To dispense product, the liquid piston 32 is moved against the bias of the spring 34 (upwardly in the orientation of FIG. 2) to an actuated position in which the liquid chamber has a compressed volume that is less than the expanded volume. The change in volume increases the pressure in the liquid chamber 26, causing the inlet valve 28 to close off communication with the interior of the container 16 at inlet 22. The increase in pressure causes the outlet valve 30 to open, and a portion of the liquid S in liquid chamber 26 exits to a dispensing pathway 36.

While the operation just disclosed with respect to the liquid chamber 26, valves 28, 30, spring 34 and the liquid piston 32 are sufficient for the dispensing of liquid S, it should also be appreciated that the reciprocating piston pump 14 can further include, as shown, an air chamber 38 and an air piston 40. The piston 40 is termed an "air" piston because is serves to pump air. The air piston 40 would move with the movement of the liquid piston 32 to compress the volume of the air chamber 38 to force air from the air chamber 38 into the dispensing pathway 36 where the air mixes with the liquid S to create a foam product. In such instances, the liquid S is a foamable liquid, and a screen or foaming chip 48 would be provided along the dispensing pathway 36 to facilitate the creation of foam. For example, a liquid soap produces a foam soap product when mixed in this manner, and some sterilizer formulations can also foam in this manner.

In dispensers such as wall-mounted dispensers 10, the reciprocating piston pump 14 is employed in an inverted position as shown in FIGS. 1 and 2, with the reciprocating piston pump 14 positioned partially in the neck 42 of the container 16 and held therein by an cap portion 45 threaded over the neck 42 of the container 16. The inlet 22 of the axial extension 24 extends well into the interior of the container 16, above an established floor of the container 16. As shown in FIG. 2, the reciprocating piston pump 14 might entirely fill in the neck 42, such that a floor 17 would be established at the bottom of the container 16, with the liquid S in the container 16 being able to reach that floor 17 in the inverted positioning of the container 16. Alternatively, as shown in FIG. 3, the reciprocating piston pump 14 may fit intimately in the neck 42 with its structure such that it provides a lowermost floor 29 (at the exterior sloped surface of the reciprocating piston pump 14) for the contents of the container 16. In such an instance, the pump itself would be considered as providing a floor for the liquid.

In the inverted positioning just described, once the level of liquid in the container 16 falls below the inlet 22 of the axial extension 24, subsequent actuation of the reciprocating piston pump 14 will not draw liquid from the container and into the liquid chamber 26, and much of the contents of the refill unit 18 will be wasted (or at least be incapable of being dispensed by further actuation of the inverted reciprocating piston pump 14). Particularly, that volume of liquid S existing between the inlet 22 and the floor of the container 16, whether of a type like floor 17 or floor 29 described above, will not be capable of being dispensed by further actuation of the inverted reciprocating piston pump 14. This leads to a significant waste of liquid S.

This problem has been addressed in the prior art by providing either a curved dip tube or an uptake shroud to redefine the inlet to the pump at a different, lower position than is established without them. In FIG. 3, a curved dip tube 44 fluidly communicates with inlet 22 and effectively provides the reciprocating piston pump 14 with an inlet 22*b* at a position much lower than that for inlet 22. Similarly, in FIG. 4, an uptake shroud 46 fluidly communicates with inlet 22 and effectively provides the reciprocating piston pump 14 with an inlet 22*c* at a position much lower than that for inlet 22.

A curved dip tube or uptake shroud in the pump design increases the complexity of the pump and the costs to manufacture it, particularly due to material costs and the additional manufacturing steps necessary to product and connect those structures.

SUMMARY OF THE INVENTION

A pump for use in an inverted dispenser is disclosed herein. In one embodiment, the liquid pump includes a fluid chamber that has a top portion when in the inverted position and at least one side wall located below the top portion. A liquid intake port extends through the at least one side wall and allows fluid to flow into the fluid chamber. The pump also includes a check valve to prevent fluid from flowing out of the fluid chamber through the fluid intake port that is located in the at least one side wall. Actuation of the liquid pump in a first direction causes fluid to enter the fluid chamber through the fluid intake port and actuation of the liquid pump in a second direction causes liquid to exit the fluid chamber trough the fluid chamber outlet and out of a dispensing outlet. In one embodiment, the check valve is an elastomeric valve. The elastomeric valve may include a top portion to seal of an inlet opening in the top of an existing pump to convert the pump into a pump having an inlet opening below the top of the pump. In another embodiment, the fluid piston in the liquid pump is the check valve that seals off the intake opening from the fluid chamber when the fluid piston is moved past the inlet opening.

In accordance with one inventive aspect of this invention, a reciprocating piston pump is provided having a new beneficial structure. The reciprocating piston pump includes a liquid chamber defined in part by a liquid chamber sidewall extending in an axial direction. A liquid piston is provided in the liquid chamber and reciprocates in the axial direction to actuate the pump and refill the liquid chamber, the axial movement of the liquid piston in one direction resulting in the intake of liquid from a liquid source into the liquid chamber, and the axial movement of the liquid piston in an opposite direction resulting in the expulsion of liquid from the liquid chamber. A liquid chamber inlet extends through the liquid chamber sidewall, wherein the intake of liquid resulting from movement of the liquid piston occurs at the liquid chamber inlet. An elastomeric valve is positioned within the liquid chamber, wherein, when the liquid piston is moved to expel liquid from the liquid chamber, the elastomeric valve covers the liquid chamber inlet in a sealing engagement therewith, and, when the liquid piston is moved to intake liquid from the container into the liquid chamber, the elastomeric valve is drawn off of the liquid chamber inlet, out of sealing engagement therewith.

In accordance with one inventive aspect of this invention, the present invention provides an improvement in pumps employed in inverted containers holding a liquid to be dispensed. The inverted container has a downwardly-directed neck, and the pump fits at least partially within the neck. A floor is defined in the container as the lowest level within the container that the contents of the container may reach in the inverted position. The pump has a liquid chamber defined by a liquid chamber sidewall, and a liquid piston is received in the liquid chamber to reciprocate therein during actuation of the pump, the movement of the liquid piston in one direction results in the intake of liquid from the container into the liquid chamber and movement in an opposite direction results in the expulsion of liquid from the liquid chamber. A length of the liquid chamber sidewall extends into the interior of the container to a distal end positioned above the floor defined in the container. The pump is improved by providing said distal end as a closed distal end and providing a liquid chamber inlet extending through the liquid chamber sidewall below the closed distal end, wherein the intake of liquid resulting from movement of the liquid piston occurs at the liquid chamber inlet such that liquid in the container can be drawn into the liquid chamber until the level of liquid in the container falls below said liquid chamber inlet, which level is below the closed distal end of the liquid chamber. The pump is further improved by providing an elastomeric valve within the liquid chamber covering the liquid chamber inlet in a sealing engagement therewith, when the liquid piston is moved to expel liquid from the liquid chamber, and being drawn off of said liquid chamber inlet, out of sealing engagement therewith, when the liquid piston is moved to intake liquid from the container into the liquid chamber. Inasmuch as the distal end of the liquid chamber sidewall is typically open and defines the inlet to the liquid chamber, closing off the distal end and providing the liquid chamber inlet through the liquid chamber sidewall, with an elastomeric valve covering the same, improves the pump by defining a lower intake for liquid within the container.

In accordance with yet another aspect of this invention, a method is provided for altering a pump employed in an inverted container, the alteration serving to place the pump inlet closer to a floor defined in the inverted container. The pump being altered is of the type that is employed in an inverted container having a downwardly-directed neck, the pump being at least partially positioned in the downwardly-directed neck and having a pump chamber defined in part by a liquid chamber sidewall extending above the floor, into the body of the container. An axial pump inlet communicates with the pump chamber and extends axially from the pump chamber away from the floor defined in the inverted container. The method of altering this type of pump includes the steps of (1) closing off the axial inlet, (2) providing a liquid chamber inlet extending through the liquid chamber sidewall transverse to the axial direction of extension of the axial inlet, and (3) placing an elastomeric valve in the liquid chamber to cover the liquid chamber inlet and moving into sealing engagement with the liquid chamber inlet in response to an increase in pressure in the liquid chamber and moving out of sealing engagement with the liquid chamber inlet in response to a decrease in pressure in the liquid chamber.

DETAILED DESCRIPTION OF ILLUSTRATIVE EMBODIMENTS

Pumps, whether liquid or foam pumps are known and though a specific embodiment showing specific chamber structures, piston structures and outlet valve structures is disclosed, this invention is not limited to or by any specific structure for the known elements. For example, even though a poppet valve is shown for outlet valve, other valves can be and are employed in reciprocating piston pump structures that may be used in combination with the present invention. Accordingly, the present invention is not limited to or by any particular outlet valve or piston structure. Embodiments of this invention disclose concepts for the improving the liquid chamber inlet and inlet valve for both liquid pumps and foam pumps, particularly for use in an inverted position.

Figure 5:
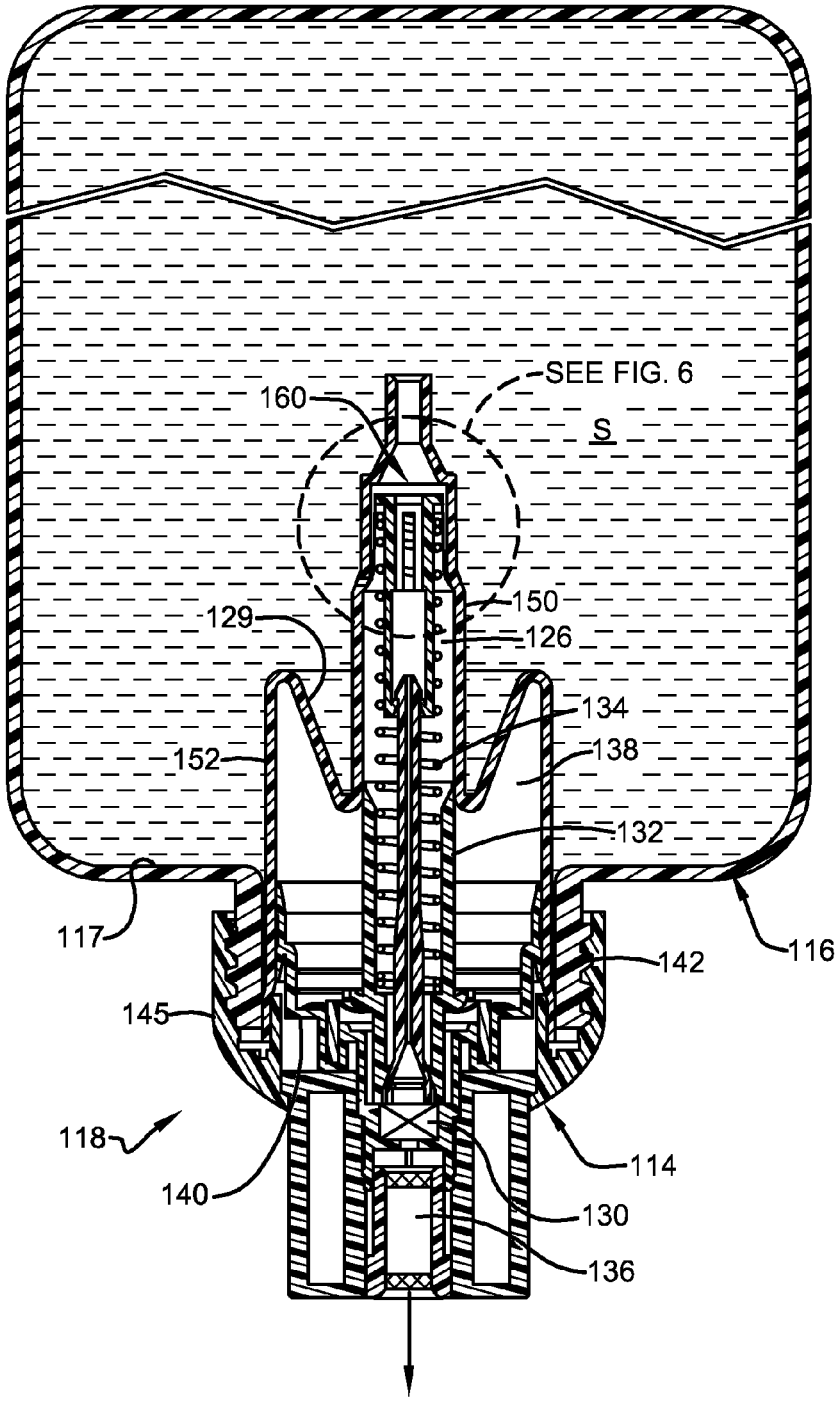
FIG. 5 is a cross-sectional view of a refill unit including a schematically represented pump having an improved liquid chamber inlet and inlet valve in accordance with this invention.
Figure 6:
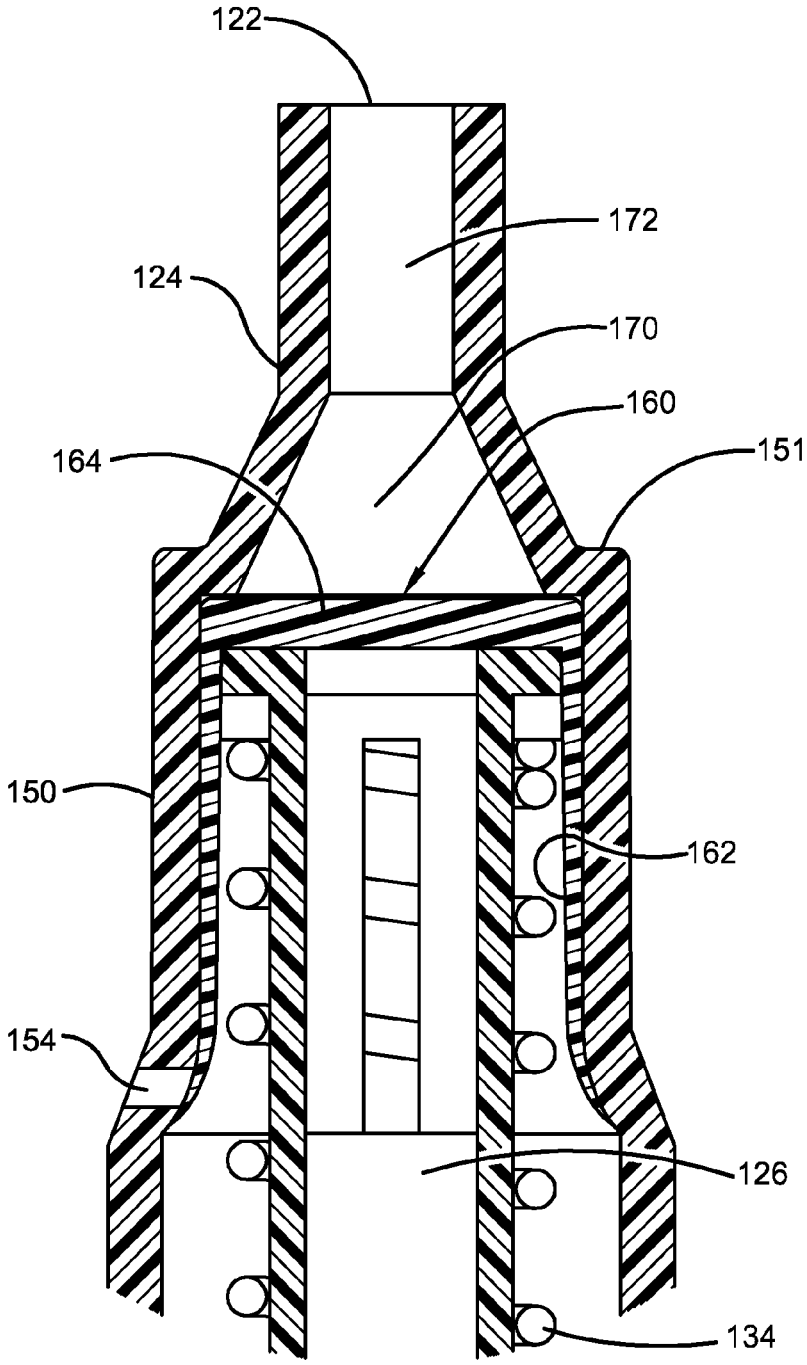
FIG. 6 is an exploded view of the improved liquid chamber inlet and inlet valve in accordance with this invention.

Referring now to FIGS. 5 and 6, a refill unit in accordance with an embodiment of the present invention is shown and designated by the numeral 118. This refill unit 118 includes a reciprocating piston pump 114 that fluidly communicates with liquid S within a container 116. Elements of the reciprocating piston pump 114 are not specifically disclosed beyond what was disclosed as background herein because the pump may take many forms. Embodiments of the present invention relate to the structure of the inlet to the liquid chamber and inlet valves that interacts with that liquid chamber inlet. Thus, the reciprocating piston (or pistons in the case of a foam pump) and the outlet valve structures (whether ball valves, flapper valves, duckbill valves or any other appropriate type of valve) are fungible, and the concepts herein can be practiced with a wide variety of piston and valve structures suitable for advancing liquid (and air, in the case of a foam pump) to a dispensing pathway from a liquid chamber (the air being advanced from an air chamber in the case of a foam pump). The reciprocating piston pump 114 shown in FIG. 5 is a foam pump, but the concepts herein are readily practiced with a plain liquid pump.

In FIG. 5, the reciprocating piston pump 114 is positioned partially within the neck 142 of the container 116. The reciprocating piston pump 114 is shown as a foam pump having a liquid chamber 126, defined in part by a liquid chamber side wall 150, an air chamber 138, defined in part by an air chamber side wall 152, a liquid piston 132, and air piston 140 and a dispensing pathway 136. A cap portion 145 secures the pump 114 to the neck 142. As is common in many foam pumps of the prior art, the air chamber side wall 152 is integral with the liquid chamber side wall 150, as at the sloped surface 129. A liquid piston 132 is biased by a spring 134 to a rest position shown in FIG. 5. Movement of the liquid piston 132 in an upward direction in the orientation of FIG. 5 results in a decrease in the volume of the liquid chamber 126 such that the contents of the liquid chamber 126 are advanced to a dispensing pathway 136 through an outlet valve as generally represented at 130. An air piston 140 is associated with the liquid piston 132 to move therewith such that the volume of the air chamber 138 is decreased as the liquid piston 132 is moved upwardly in the orientation of FIG. 5, and this would cause air within the air chamber 138 to advance to the dispensing pathway 136. The air and liquid would mix at dispensing pathway 136 to create a coarse mixture. As generally known, this coarse mixture of air and liquid would be extruded through a foaming chip 148 or screen or mesh to create a high quality foam.

One improvement herein is the creation of a liquid chamber inlet in the side wall 150 defining the liquid chamber 126. In one embodiment, further improvements include a liquid chamber inlet valve, such as, for example an elastomeric valve positioned in the interior of the liquid chamber 126. With reference to both FIGS. 5 and 6, it can be seen that a liquid chamber inlet 154 extends through the liquid chamber side wall 150. Elastomeric valve 160 is positioned in the liquid chamber 126 and conforms to at least a portion of the inner surface of the liquid chamber side wall 150. Particularly, the elastomeric valve 160 conforms to the liquid chamber side wall 150 at least at the liquid chamber inlet 154. In this particular embodiment, the elastomeric valve 160 is cup-shaped, having a sleeve portion 162 and a cap portion 164, with the sleeve portion 162 extending axially to cover the liquid chamber inlet 154. The cup-shaped elastomeric valve 160 is held in place by the spring 134, which seats the cap portion 164 against a step 151 in the side wall 150 the cap portion 164 spans across a passageway 170 defined by an axial extension 124 of the side wall 150, and, in this manner, serves as a closed distal end for the liquid chamber 126. This specific cup-shaped elastomeric valve 160 can be employed in a prior art pump having an axially-extending liquid chamber with an axial pathway 172 defined by an axial extension 124 providing a what would be a pump inlet 122, though the cup-shaped elastomeric valve 160 closes off the pathway 172, making the prior art inlet 122 non-functional. Instead, the cup-shaped elastomeric valve 160 interacts with a new liquid chamber inlet 154 extending through the side wall 150, and, in this manner, the new reciprocating piston pump 114 can withdraw more of the liquid contents of the container 116, as compared to an identical pump employing the pump inlet 122, pathway 172 and an appropriate inlet valve (for example, ball valve 28 of the prior art embodiment of FIG. 2) to regulate the intake of liquid S into the liquid chamber 126. Particularly, whereas the pump employing the inlet at 122 would have only been able to withdraw the contents of the container 116 to a point where the level reaches inlet 122, the new reciprocating piston pump 114 can withdraw contents from the container 116 until the level reaches liquid chamber inlet 154. Thus the liquid chamber inlet and inlet valve permits a more efficient use of the contents of a container employed in an inverted position.

Figure 1:
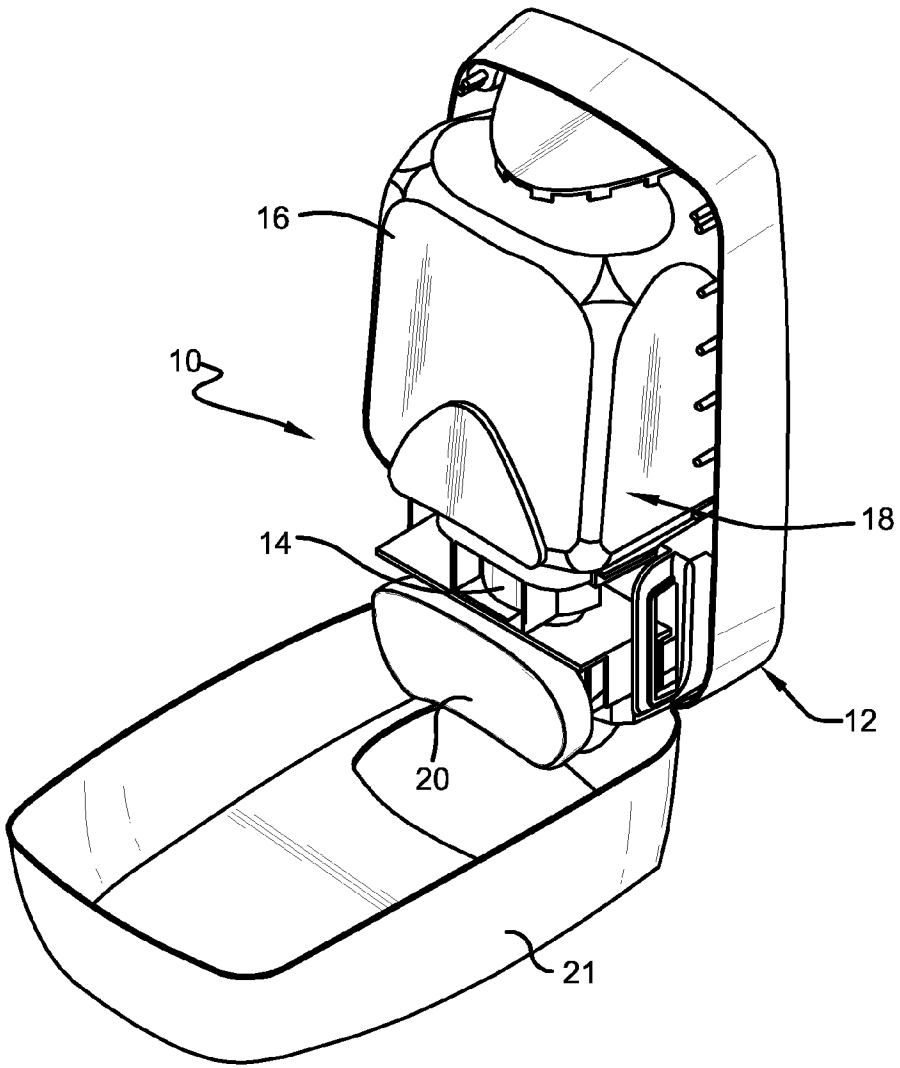
FIG. 1 is a perspective view of a prior art dispensing system showing a dispenser housing that receives a combination pump and container (the combination also be referred to as a refill unit) in an inverted position.
Figure 2:
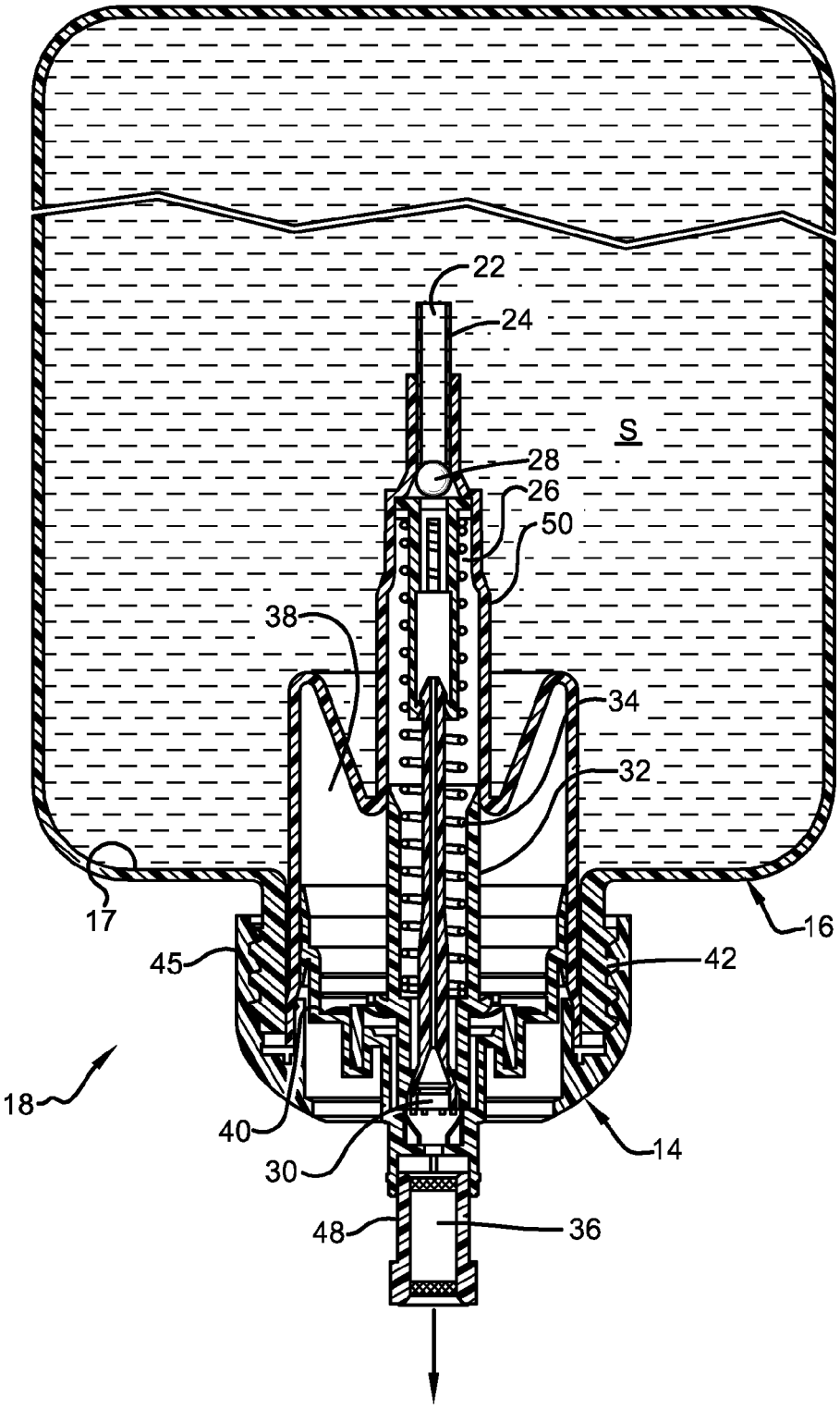
FIG. 2 PRIOR ART
FIG. 2 is a cross-sectional view of a refill unit of the prior art, shown without any structures serving to better dispenser the contents of the container.
Figure 3:
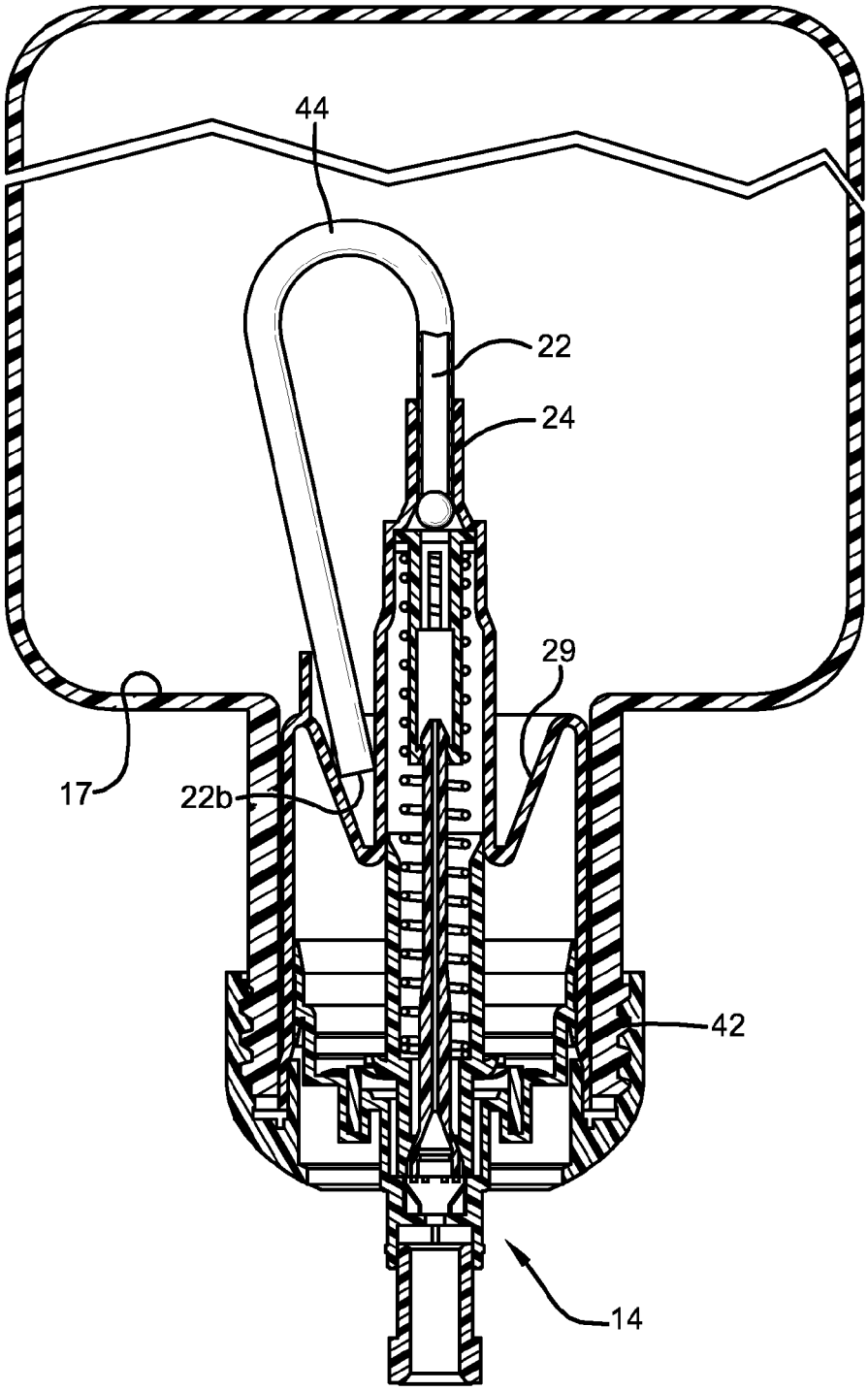
FIG. 3 PRIOR ART
FIG. 3 is a cross-sectional view of a refill unit of the prior art, shown with a curved dip tube structure serving to better dispenser the contents of the container.
Figure 4:
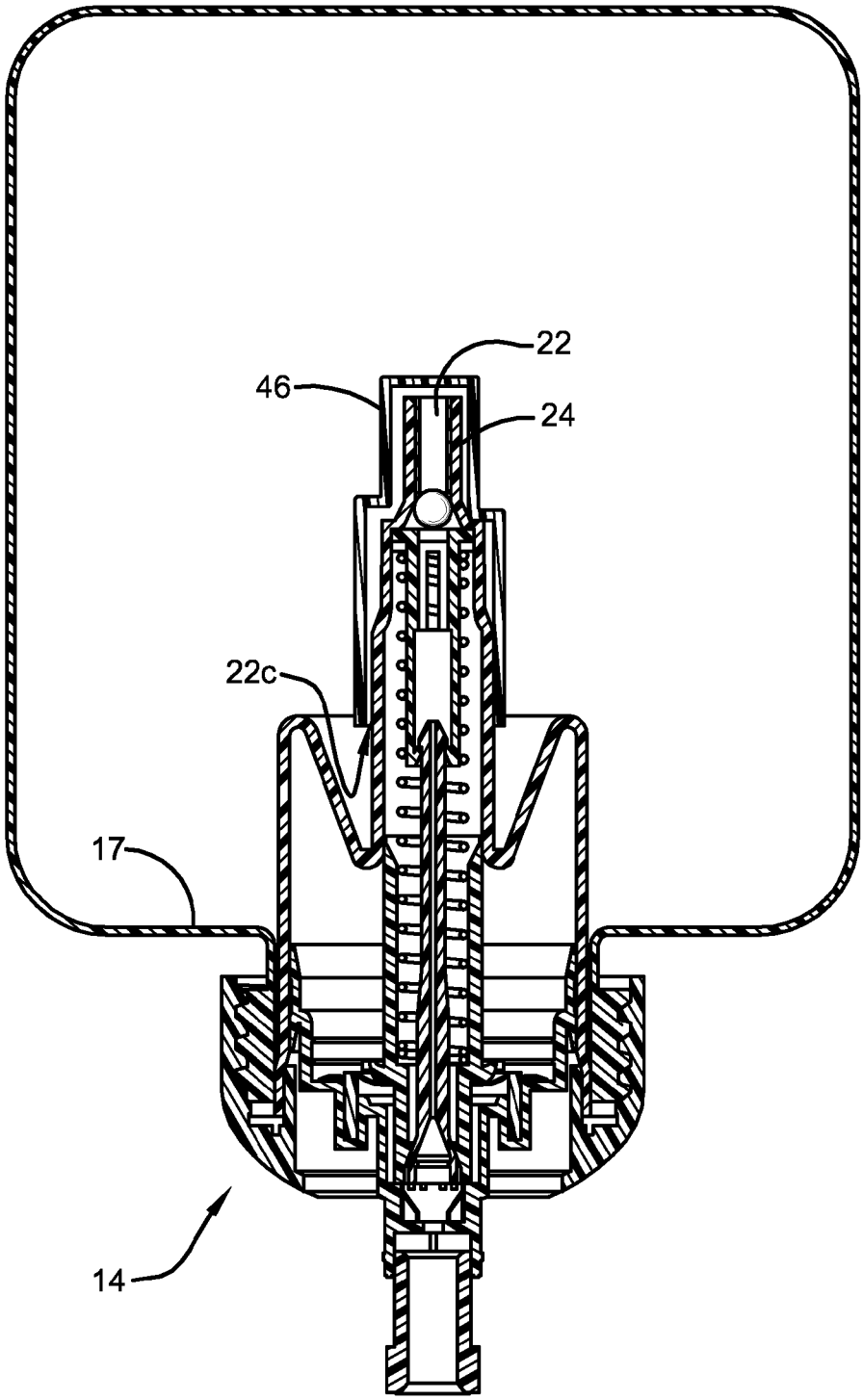
FIG. 4 PRIOR ART
FIG. 4 is a cross-sectional view of a refill unit of the prior art, shown with an uptake shroud structure serving to better dispenser the contents of the container.

As can be seen by comparing FIG. 5 with FIG. 2 and considering the disclosure above, this embodiment may be used to convert a prior art pump having an axial inlet like that at pump inlet 22 (FIG. 2) to an improved pump, such as pump 114, employing an inlet through a liquid chamber sidewall, like the inlet at 154. Accordingly, a method for altering a pump employed in an inverted container is provided herein, the alteration serves to place the pump inlet closer to a floor defined in the inverted container. The pump being altered may of the type that is employed in an inverted container having a downwardly-directed neck, in one embodiment, the pump is at least partially positioned in the downwardly-directed neck and has a pump chamber defined in part by a liquid chamber sidewall extending above the floor into the body of the container. An axial pump inlet communicates with the pump chamber and extends axially from the pump chamber away from the floor defined in the inverted container. The method of altering this type of pump includes the steps of closing off the axial inlet, and providing a liquid chamber inlet extending through the liquid chamber sidewall generally transverse to the axial direction of extension of the axial inlet. One embodiment further includes placing an elastomeric valve in the liquid chamber to cover the liquid chamber inlet, wherein the elastomeric valve moves into sealing engagement with the liquid chamber inlet in response to an increase in pressure in the liquid chamber, or because the elastomeric valve is naturally biased to seal the liquid chamber, and moves out of sealing engagement with the liquid chamber inlet in response to a decrease in pressure in the liquid chamber.

Figure 7:
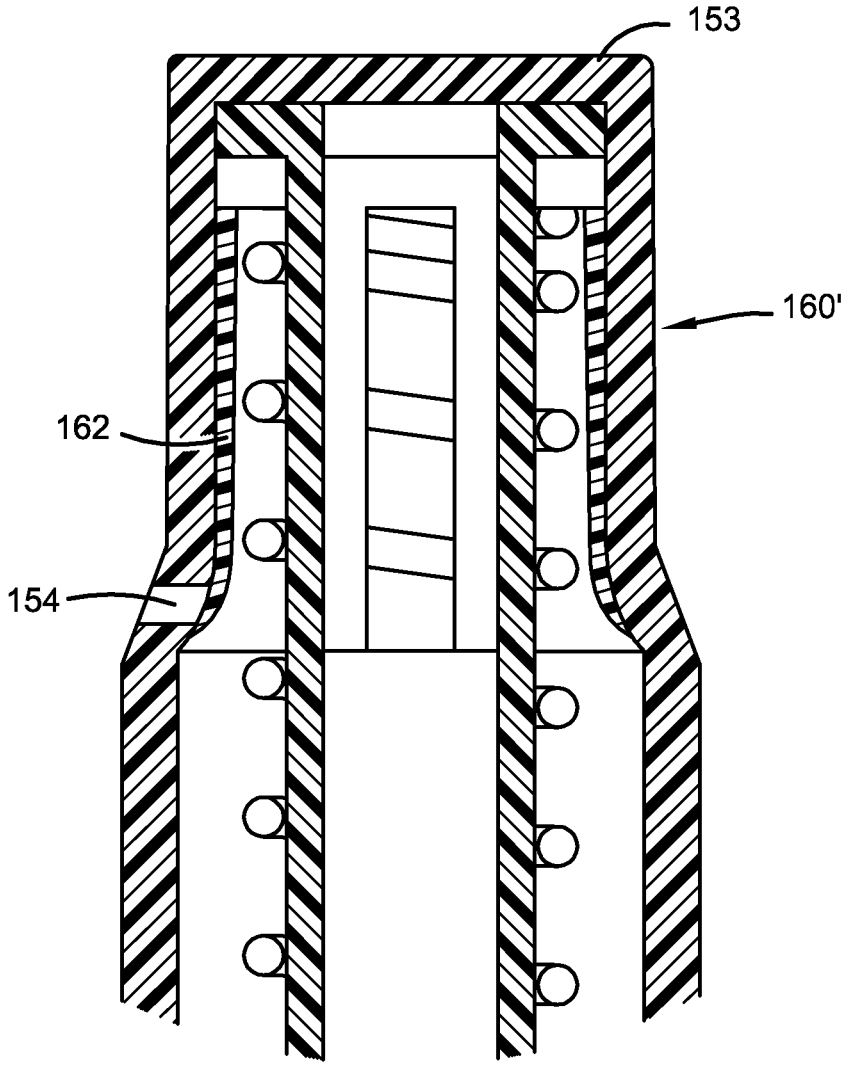
FIG. 7 is a cross-sectional view of a second embodiment of a refill unit including a schematically represented pump having an improved liquid chamber inlet and inlet valve in accordance with this invention.

Although the embodiment shown in FIGS. 5 and 6 includes structure used to convert a prior-art pump having an axial extension 124 and inlet 122 communicating with a liquid chamber 126, it should be appreciated that the concepts of this invention could be practiced in newly-created pumps. In a newly-created pump there may not be an axial extension 124. For example, referring now to FIG. 7, the side wall 150 could simply be closed off at a distal end 153, eliminating the axial extension 124 beyond the steps 151 in the embodiment of FIG. 5. With the liquid chamber closed at this distal end 153, the elastomeric valve 160 could simply be an annular valve or sleeve valve 160' of a suitably elastic material, having only a sleeve portion 162 and no cap portion 164.

Figure 8:
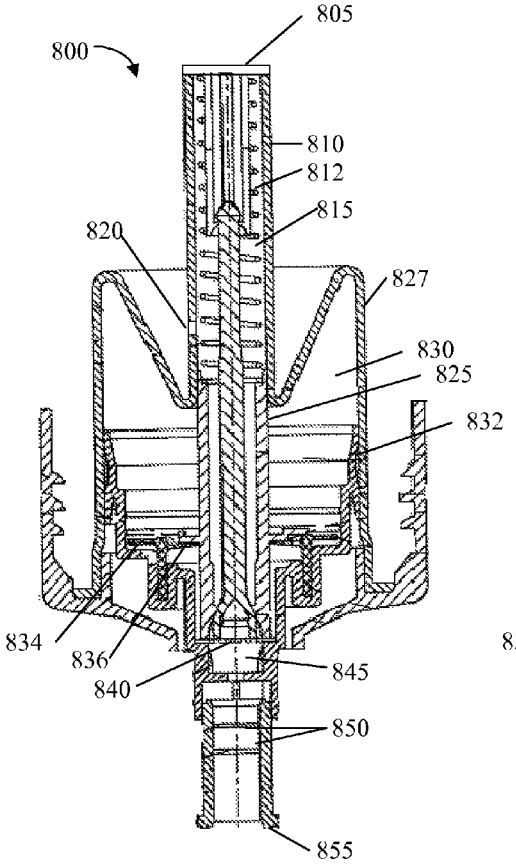
FIG. 8 is a cross-sectional view of another embodiment of an inverted pump having a side inlet with the pump in an extended position.
Figure 9:
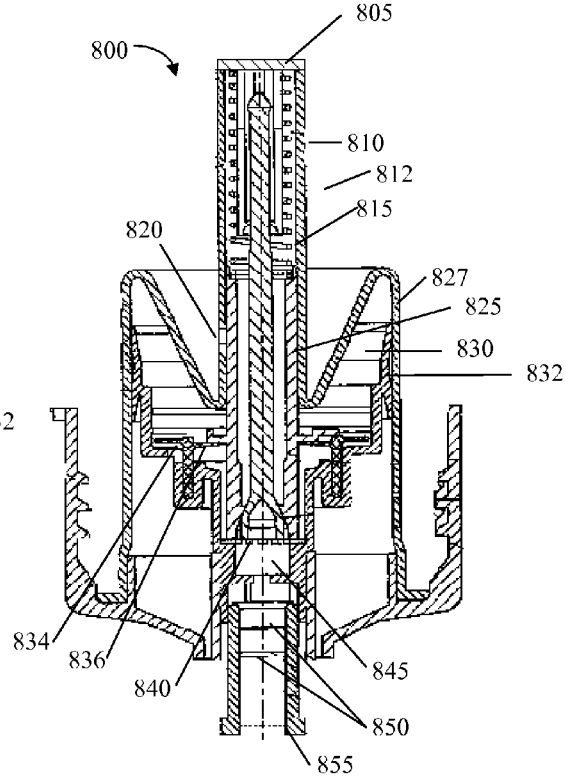
FIG. 9 is a cross-sectional view of the pump in FIG. 8 shown in a compressed position.

FIGS. 8 and 9 illustrate another embodiment of a pump in accordance with the present invention. Pump 800 is a foam pump and includes a liquid chamber 815 and an air chamber 830. Many of the functions of pump 800 are described in more detail in U.S. Pat. No. 6,536,629, which is incorporated herein by reference. Accordingly, only basic elements of pump 800 and differences between pump 800 and U.S. Pat. No. 6,536,629 are described below. Liquid chamber 815 is defined in part by a top 805 and sidewall 810. An inlet opening 820 is included in the sidewall 810 below the top 805. Liquid flows through inlet opening 820 and into liquid chamber 815. Liquid piston 825, which is biased in the extended position by spring 812, engages and creates a seal along sidewall 810. In addition, pump 800 also includes an air chamber 830 defined in part by wall 827 and air piston 832. Air piston 832 seals against the wall 827 of the air piston 832.

During operation, liquid piston 825 moves up toward top 805 and decreases the volume of liquid chamber 815. Liquid piston 825 seals inlet 820 as the top portion of liquid piston 825 moves beyond inlet 820. Accordingly, liquid piston 825 acts as a check valve preventing liquid from exiting liquid chamber 815 through inlet 820. Optionally, an elastomeric element may be added to the top of liquid piston 825 to act as a check valve when moved above inlet opening 820. As the liquid piston 825 is moved toward top the volume of the liquid chamber 815 is reduced and liquid is forced out of the liquid chamber past outlet valve 840 into mixing chamber 845. Simultaneously, air chamber 30 moves upward reducing the volume of air chamber 30. Air passes out of air chamber 30 through air outlet valve 836 and passes into mixing chamber 845 where it mixes with the liquid exiting from the liquid chamber 815. The liquid/air mixture is forced through screens 850 and becomes a foam that is dispensed through outlet 855.

FIG. 9 illustrates pump 800 in a compressed position. After the dispensing cycle, the pressure created while reducing the volume of the liquid chamber 815 is reduced and liquid outlet valve 840 closes. Spring 812 pushes liquid piston 825 and air piston 832 back to their extended states. Because outlet valve 840 is closed, a vacuum is created in liquid chamber 815 as the liquid piston 825 moves back to its extended state. Once the top of liquid piston 825 moves below inlet 820, the vacuum created in liquid chamber 815 causes the liquid to flow through inlet 820 and up into liquid chamber 815. Simultaneously, air outlet valve 836 closes and a vacuum is created in air chamber 830, which causes air inlet valve 834 to open allowing air to flow into air chamber 830.

Figure 10:
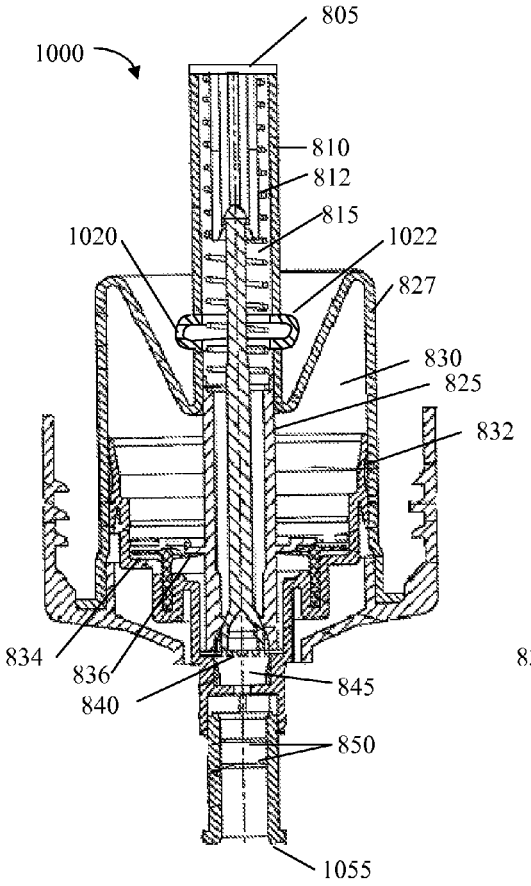
FIG. 10 is a cross-sectional view of another embodiment of an inverted pump having a side inlet with the pump in an extended position.
Figure 11:
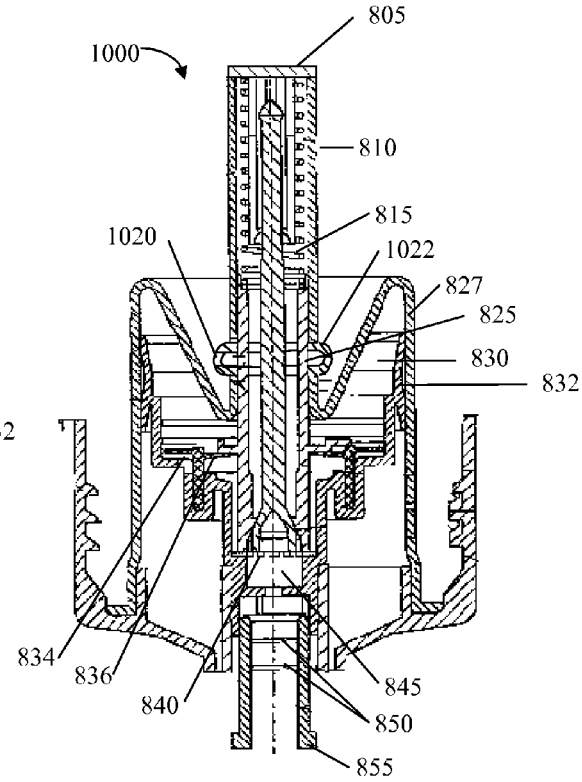
FIG. 11 is a cross-sectional view of the pump in FIG. 8 shown in a compressed position.

FIGS. 10 and 11 illustrate another embodiment of a pump in accordance with the present invention. FIG. 10 illustrates pump 900 in an extended position, and FIG. 11 illustrates pump 900 in a compressed position. Pump 900 is similar to pump 800 and common features, are identified with the same numerals are not redescribed here. Pump 900 includes an annular chamber 1022 at inlet 1020. Annular chamber 1022 allows liquid to surround liquid piston 825 when liquid piston 825 is moved toward the top 805 of pump 900. When liquid piston 825 moves from a compressed position (i.e. liquid piston 825 is in its uppermost position) toward an extending position it creates a vacuum. If the vacuum is too strong, it may attempt to draw air around the liquid piston 825 from the air chamber 830. However, annular chamber 1020 located between the liquid chamber 815 and air chamber 830 is filled with liquid. Accordingly, the liquid in annular chamber 1022 prevents air from being drawn from air chamber 830 around fluid piston 825 into liquid chamber 815.

Optionally, in addition to, or instead of, annular chamber 1022, liquid piston 825 may have one or more annular grooves (not shown) to receive one or more o-ring seals (not shown) to prevent vacuum pressure from escaping around liquid piston 825. In addition, in one embodiment, top 805 is configured to fit over the top of a standard pump having an inlet opening of the top of the pump. Thus, top 805 may be used to close off the top of a standard pump to convert the pump into pump 800 or pump 900.

While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A reciprocating piston pump for use in an inverted position comprising:

a liquid chamber defined in part by a liquid chamber sidewall extending in an axial direction;

a liquid piston in said liquid chamber, wherein said piston reciprocates in said axial direction to actuate the pump and refill said liquid chamber, the axial movement of said liquid piston in one direction resulting in the intake of liquid from a liquid source into said liquid chamber, and the axial movement of said liquid piston in an opposite direction resulting in the expulsion of liquid from said liquid chamber;

a liquid chamber inlet extending through said liquid chamber sidewall, wherein the intake of liquid resulting from movement of said liquid piston occurs at said liquid chamber inlet, an elastomeric valve positioned within said liquid chamber, wherein said liquid piston is moved to expel liquid from the liquid chamber, said elastomeric valve covers said liquid chamber inlet in a sealing engagement therewith, and, when the liquid piston is moved to intake liquid from said container into said liquid chamber, said elastomeric valve is drawn off of said liquid chamber inlet, out of sealing engagement therewith, and an air pump wherein actuation of the air pump in a first direction causes air to enter into an air pump chamber through an air intake port and actuation of the air pump in a second direction causes air to exit the air pump into a mixing chamber wherein the air and the liquid from the liquid chamber are mixed together and the mixture flows through a mixing medium and is dispensed as a foam out of a dispensing outlet.

2. The reciprocating piston pump of claim 1, wherein said liquid chamber inlet extends through said liquid chamber sidewall in a direction transverse to said axial direction.

3. The reciprocating piston pump of claim 1, wherein said elastomeric valve is in the form of a sleeve that conforms to the inner periphery of the liquid chamber sidewall.

4. The reciprocating piston pump of claim 3, wherein said sleeve is annular, conforming to the inner diameter (ID) of the liquid chamber sidewall.

5. The reciprocating piston pump of claim 1, wherein the elastomeric valve is generally cup-shaped, with said sleeve portion and a cap portion, said sleeve portion conforming to the inner periphery of the liquid chamber sidewall, and said cap portion defining a closed end of said liquid chamber.

6. A reciprocating piston pump comprising:

a liquid chamber defined in part by a liquid chamber sidewall extending in an axial direction;

a liquid piston in said liquid chamber, wherein said piston reciprocates in said axial direction to actuate the pump and refill said liquid chamber, the axial movement of said liquid piston in one direction resulting in the intake of liquid from a liquid source into said liquid chamber, and the axial movement of said liquid piston in an opposite direction resulting in the expulsion of liquid from said liquid chamber;

a liquid chamber inlet extending through said liquid chamber sidewall, wherein the intake of liquid resulting from movement of said liquid piston occurs at said liquid chamber inlet, and an elastomeric valve positioned within said liquid chamber, wherein said liquid piston is moved to expel liquid from the liquid chamber, said elastomeric valve covers said liquid chamber inlet in a sealing engagement therewith, and, when the liquid piston is moved to intake liquid from said container into said liquid chamber, said elastomeric valve is drawn off of said liquid chamber inlet, out of sealing engagement therewith;

wherein the elastomeric valve is generally cup-shaped, with a sleeve portion and a cap portion, said sleeve portion conforming to the inner periphery of the liquid chamber sidewall, and said cap portion defining a closed end of said liquid chamber; and wherein said pump includes an axial extension and an opening at a distal end thereof, said cap portion of said elastomeric valve closing off said opening.

7. A refill unit for a dispenser in which the refill unit is received in an inverted position, the refill unit comprising:

a container holding liquid to be dispensed, the container including a ceiling and a neck, wherein, in the inverted position in which the refill unit is received in the dispenser, said ceiling is above said neck;

a pump secured to the neck of said container, wherein, in the inverted position in which the refill unit is received in the dispenser, a portion of said pump defines a floor for the liquid, said pump including:

a liquid chamber defined by a liquid chamber sidewall and having a closed distal end inside of the interior of the container above said floor defined by a portion of said pump, a liquid piston received in said liquid chamber and reciprocating in an axial direction toward and away from said ceiling to actuate said pump and refill said liquid chamber, the movement of said liquid piston away from said ceiling resulting in the intake of liquid from said container into said liquid chamber and movement of said liquid piston toward said ceiling resulting in the expulsion of liquid from said liquid chamber, wherein a length of said liquid chamber sidewall extends into the interior of the container beyond the neck of the container and above said floor defined by a portion of said pump, a liquid chamber inlet extending through said liquid chamber sidewall below said closed distal end, wherein the intake of liquid resulting from movement of said liquid piston occurs at said liquid chamber inlet, a check valve within said liquid chamber, wherein, when said the liquid piston is moved to expel liquid from the liquid chamber, said check valve covers said liquid chamber inlet in a sealing engagement therewith, and, when the liquid piston is moved to intake liquid from said container into said liquid chamber, said check valve is drawn off of said liquid chamber inlet, out of sealing engagement therewith, and an air pump wherein actuation of the air pump in a first direction causes air to enter into an air pump chamber through an air intake port and actuation of the air pump in a second direction causes air to exit the air pump into a mixing chamber wherein the air and the liquid from the liquid chamber are mixed together and the mixture flows through a mixing medium and is dispensed as a foam out of a dispensing outlet.

8. The refill unit of claim 7 wherein the check valve is an elastomeric valve located at least partially on the interior of the liquid chamber.

9. The refill unit of claim 8 wherein the elastomeric valve is a sleeve valve.

10. A piston pump for use in an inverted dispenser comprising:

a liquid pump having a fluid chamber, the fluid chamber having a top portion when in the inverted position, and at least one sidewall below the top portion, a fluid intake port in the at least one sidewall, wherein the fluid intake port allows fluid to flow into the fluid chamber, a liquid piston;

a check valve to prevent fluid from flowing out of the fluid chamber through the fluid intake port, wherein actuation of the liquid pump in a first direction causes fluid to enter the fluid chamber through the fluid intake port and actuation of the liquid pump in a second direction causes liquid to exit the fluid chamber through the fluid chamber outlet and out of a dispensing outlet; and further comprising an air pump portion wherein actuation of the air pump in a first direction causes air to enter into the air pump chamber through an air intake port and actuation of the air pump in a second direction causes air to exit the air pump into a mixing chamber wherein the air and the fluid are mixed together and the mixture flows through a mixing medium and is dispensed as a foam out of the dispensing outlet.

11. The pump of claim 10 wherein the check valve is an elastomeric valve positioned within the fluid chamber.

12. The pump of claim 11 wherein the elastomeric valve comprises a sleeve.

13. The pump of claim 11 wherein the elastomeric valve has a cup shape that seals a second inlet port.

14. The piston pump of claim 10 wherein the liquid piston is both the check valve and the liquid piston.

15. A refill unit for a foam piston pump dispenser comprising:

a container for holding a liquid, a foam pump secured to the liquid container, the foam pump including a liquid pump section having a liquid piston, an air pump section, a mixing chamber, and a dispensing outlet, wherein the liquid pump section includes a fluid chamber having a top portion when the foam pump is placed in an inverted position, the top portion preventing fluid from entering the fluid chamber through the top, a fluid intake port entering the fluid chamber at a point below the top of the fluid chamber, wherein fluid can flow into the fluid chamber through the fluid intake port, but does not flow out of the fluid chamber through the fluid intake port, wherein actuation of the liquid pump in a first direction causes fluid to enter the fluid chamber through the fluid intake port and actuation of the liquid pump in a second direction causes liquid to exit the fluid chamber through the fluid chamber outlet and out of a dispensing outlet; and further comprising an air pump portion wherein actuation of the air pump in a first direction causes air to enter into the air pump chamber through an air intake port and actuation of the air pump in a second direction causes air to exit the air pump into a mixing chamber wherein the air and the fluid are mixed together and the mixture flows through a mixing medium and is dispensed as a foam out of the dispensing outlet.

16. The refill unit of claim 15 wherein at least a portion of the fluid piston prevents liquid from flowing out of the fluid chamber and into the container when the fluid piston is located proximate the inlet opening.

17. The refill of claim 15 further comprising a check valve to prevent liquid from flowing out of the fluid chamber through the fluid inlet and into the container.

18. The refill of claim 17 wherein the check valve is an elastomeric member located on the interior of the fluid chamber.

19. The refill of claim 18 wherein the elastomeric member comprises a top portion to prevent liquid from entering the fluid chamber through a second fluid intake opening.

* * * * *